US006084560A

United States Patent [19]

Miyamoto

[11] Patent Number: 6,084,560

[45] **Date of Patent: *Jul. 4, 2000**

[54] IMAGE DISPLAY FOR DITHER HALFTONING

[75] Inventor: Katsuhiro Miyamoto, Isehara, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/854,738

[22] Filed: May 12, 1997

[30] Foreign Application Priority Data

May 17, 1996 [JP] Japan ..... 8-123586

[51] Int. Cl.[7] ..... G09G 3/36

[52] U.S. Cl. ..... 345/89; 345/149; 358/455

[58] Field of Search ..... 345/87, 89, 150, 345/97, 147, 149, 152–155, 199, 148; 348/472, 798, 574; 358/455, 457, 534–535, 456; 382/270

[56] References Cited

U.S. PATENT DOCUMENTS

| | | | |
|---|---|---|---|
| 3,967,052 | 6/1976 | Judice | 348/798 |
| 4,377,821 | 3/1983 | Sautter et al. | 348/472 |
| 4,987,484 | 1/1991 | Ikeda et al. | 358/534 |
| 5,353,041 | 10/1994 | Miyamoto et al. | 345/97 |
| 5,420,603 | 5/1995 | Tsuboyama et al. | 345/87 |

*Primary Examiner*—Richard A. Hjerpe
*Assistant Examiner*—Francis Nguyen
*Attorney, Agent, or Firm*—Fitzpatrick, Cella, Harper & Scinto

[57] ABSTRACT

Disclosed is an image display apparatus for dither halftoning a video signal that enters from an external unit and displaying the resulting video signal on a display unit. A dither table, which comprises an array of dither threshold values used by a dither halftoning circuit, is changed based upon the capability of the display unit to display halftone display colors and/or data relating to the number of display colors contained in the video signal. In order to select threshold values, an output value of the dither halftoning circuit, which is at an identical display position in the immediately preceding frame of the video signals is referenced.

6 Claims, 10 Drawing Sheets

IMAGE DISPLAY FOR DITHER HALFTONING

BACKGROUND OF THE INVENTION

This invention relates to an image display apparatus and method for applying dither halftoning (dithering) processing to an externally applied video signal.

Graphics cards mounted in computers are now being produced with high resolution, with the capability of displaying multiple colors and in a wide variety of types. For example, graphics cards capable of supporting as many as 16,700,000 displayed colors are now available on the market. In terms of the types of graphics cards available, these include graphics cards whose numbers of horizontal display dots and vertical display dots are 640×480 dots, 800×600 dots, 1024×768 dots, 1280×1024 dots and 1600×1280 dots, etc. Thus, resolution is steadily increasing. In addition, the video signals output by these various types of graphics cards often differ subtly in terms of timing and level.

In a case where these video signals are received and displayed on, say, a flat-panel display, there are instances where the flat-panel display does not have the capability to display the number of display colors represented by the received video data. In case of such a flat-panel display, the number of apparent display colors is enlarged by successively subjecting each of the pixels of the input video signal to dither halftoning.

However, the following problems arise in the example of the prior art set forth above:

(1) The transfer frequency of the input video signal is raised by the improvement in the resolution of the graphics card. Accordingly, when the input video signal is transferred to a dithering circuit, a technique is adopted in which the input video signal is transferred to the dithering circuit after being converted to a parallel signal (a plurality of synchronized serial signals) by a demultiplexer in order to take into account reflection of the signal and unnecessary radiation. This makes it necessary to carry out the dither halftoning process in parallel fashion for each of the serial signals. On the other hand, in case of a graphics card having a low resolution, the input video signal is not converted to a parallel signal by a demultiplexer in view of the need for better performance and to hold down cost. If the dither threshold values with which the input signal is compared are made of fixed values when it is attempted to obtain an optimum video signal commensurate with the capabilities of the graphics card and display, the output data resulting from halftoning by the dithering circuit differ, even if the input video signal is the same, depending upon whether the input video signal is subjected to dither halftoning processing in parallel after the conversion by the demultiplexer or without being converted to the parallel signal by the demultiplexer.

(2) In a case where only the part of the data to be displayed is captured from the input video signal received from the graphics card, changing the scope of the area captured results in a change in the dithered data because the dither threshold values differ depending upon the scope of the area captured.

(3) Since gamma correction values and signal levels differ depending upon the graphics card, it is necessary to correct the input video signal before dither processing is executed. If the dither halftoning circuit is constructed as an ASIC, the circuit is large in scale and problems arise in terms of cost and the evolution of heat.

(4) The numbers of colors capable of being displayed by a flat-panel display and the configurations of the color filter differ depending upon the panel. Therefore, if the size of the dither matrix and the threshold values are fixed, optimum dither halftoning cannot be executed if the panel is replaced by another. Further, the display dots and lines of a graphics card change depending upon the display mode of the graphics card. Hence, if the dither matrix is fixed, the proper color tones cannot be displaced when the display mode is changed.

(5) In a case where the input video signal is an interlaced signal such as a television signal, the threshold values used in dither halftoning are the same for both odd- and even-numbered fields and the number of apparent colors capable of being displayed as halftones decreases.

SUMMARY OF THE INVENTION

An object of the present invention is to provide an image display apparatus and method in which optimum dither halftoning can be performed in a case where the position at which an input video signal is displayed is changed and in a case where the input video signal is an interlaced signal and/or a demultiplexed signal.

According to the present invention, the foregoing object is attained by providing an image display apparatus for dither halftoning a video signal that enters from an external unit and displaying the resulting video signal on a display unit, comprising storage means for storing beforehand a plurality of dither tables in which dither threshold values used in the dither halftoning are arrayed, position information generating means for generating position information based upon data relating to capability of the display unit to display halftone display colors and/or data relating to the number of display colors included in the video signal, and changing means for selecting a dither table, in which dither threshold values used in the dither halftoning are arrayed, from the storage means in accordance with the position information generated by the position information generating means, and changing the dither table.

Alternatively, the foregoing object is attained by providing an image display apparatus for dither halftoning a video signal that enters from an external unit and displaying the resulting video signal on a display unit, comprising storage means for storing beforehand a plurality of dither tables in which dither threshold values used in the dither halftoning are arrayed, position information generating means which, if the video signal is an interlaced signal, is for generating position information based upon the interlaced signal and odd-numbered and even-numbered field signals contained in the interlaced signal, and changing means for selecting a dither table, in which dither threshold values used in the dither halftoning are arrayed, from the storage means in accordance with the position information generated by the position information generating means, and changing the dither table.

Alternatively, the foregoing object is attained by providing an image display apparatus for dither halftoning a video signal that enters from an external unit and displaying the resulting video signal on a display unit, comprising storage means for storing beforehand a plurality of dither tables in which dither threshold values used in the dither halftoning are arrayed, position information generating means which, if the video signal has been demultiplexed, is for generating position information based upon the demultiplexed video signal, and changing means for selecting a dither table, in which dither threshold values used in the dither halftoning are arrayed, from the storage means in accordance with the position information generated by the position information generating means, and changing the dither table.

According to the present invention, the foregoing object is attained by providing an image display method for dither halftoning a video signal that enters from an external unit using dither threshold values arrayed in a dither table and displaying the resulting video signal on a display unit, comprising a position information generating step of generating position information based upon data relating to capability of the display unit to display halftone display colors and/or data relating to the number of display colors included in the video signal, and a changing step of changing to a dither table, in which dither threshold values used in the dither halftoning are arrayed, in accordance with the position information generated at the position information generating step.

Alternatively, the foregoing object is attained by providing an image display method for dither halftoning a video signal that enters from an external unit using dither threshold values arrayed in a dither table and displaying the resulting video signal on a display unit, comprising a position information generating step which, if the video signal is an interlaced signal, is a step of generating position information based upon the interlaced signal and odd-numbered and even-numbered field signals contained in the interlaced signal, and a changing step of changing to a dither table, in which dither threshold values used in the dither halftoning are arrayed, in accordance with the position information generated at the position information generating step.

Alternatively, the foregoing object is attained by providing an image display method for dither halftoning a video signal that enters from an external unit using dither threshold values arrayed in a dither table and displaying the resulting video signal on a display unit, comprising a position information generating step which, if the video signal has been demultiplexed, is a step of generating position information based upon the demultiplexed video signal, and a changing step of changing to a dither table, in which dither threshold values used in the dither halftoning are arrayed, in accordance with the position information generated at the position information generating step.

Furthermore, in the apparatus or method described above, it is preferred that the threshold values used in the dither halftoning be changed in dependence upon the results obtained by comparing a value which represents a relationship between number of bits of a pixel unit in the video signal and number of bits of a dither output value obtained by the dither halftoning, and a dither output value at an identical display position in a frame which is at least one frame earlier in the video signal. As a result, flicker of the image at identical display positions is reduced.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of an image display apparatus according to the present invention will now be described in detail with reference to the accompanying drawings. The construction of the image display apparatus according to the invention will be described first.

Figure 1:
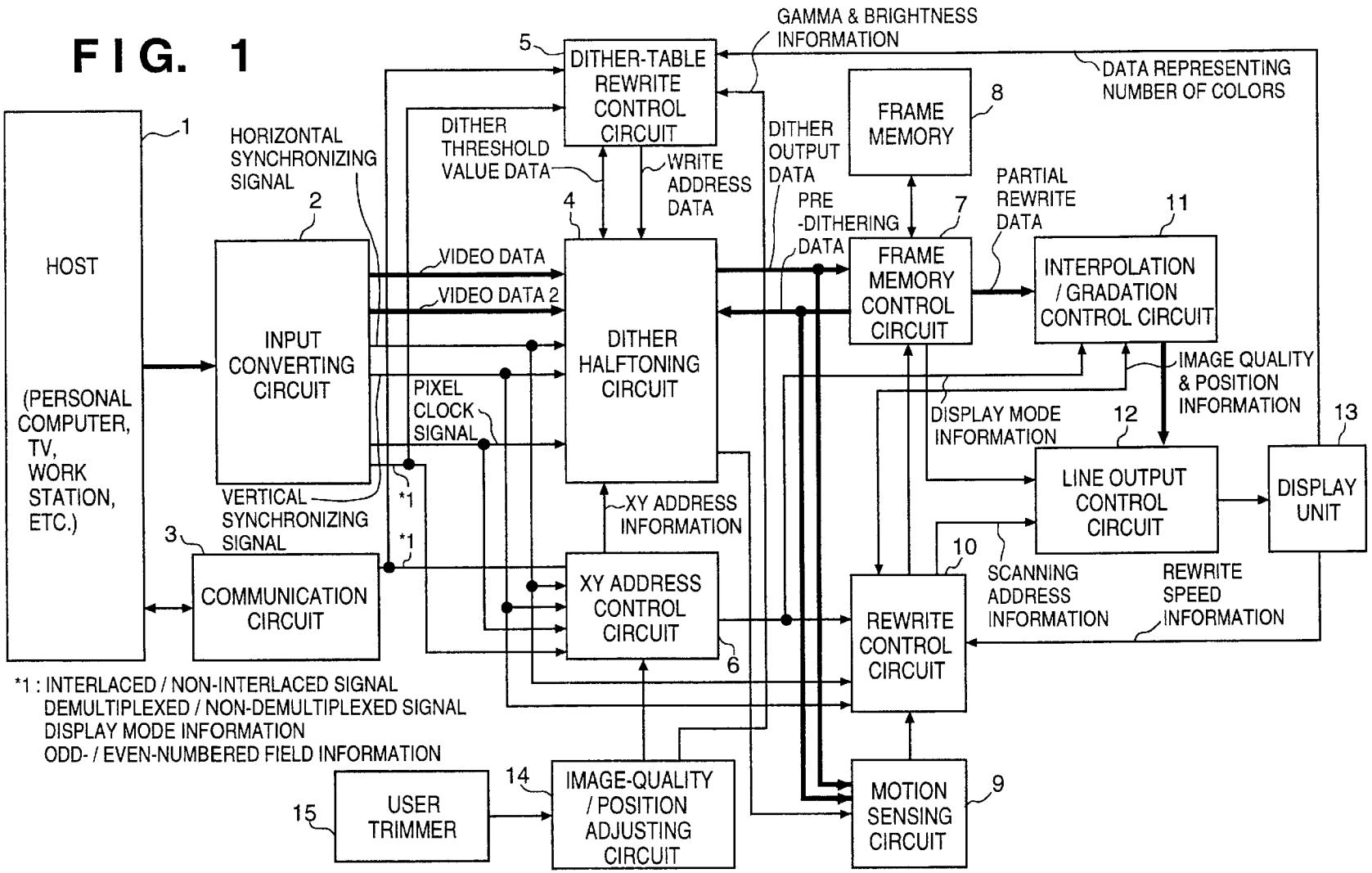
FIG. 1 is a block diagram illustrating an image display apparatus according to an embodiment of the present invention.

FIG. 1 is a block diagram illustrating an image display apparatus according to an embodiment of the present invention.

Shown in FIG. 1 is a host apparatus 1, which preferably is a personal computer, work station or television, for supplying the image display apparatus with an input video signal. An input converting circuit 2 accepts the video signal output by the host apparatus 1. The input converting circuit 2 has the following functions:

(1) a function for separating the input video signal into horizontal and vertical synchronizing signals;

(2) a demultiplexing function for subjecting the input video signal to an analog/digital (referred to as "A/D" below) conversion if the input video signal is an analog video signal, and further converting the input video signal to parallel data in accordance with the transfer speed of the input video signal;

(3) when the input video signal has been converted to parallel data by the demultiplexing function, a function for sensing the fact that a control signal, which informs of the conversion to the parallel data, and the input video signal from the host apparatus 1 are interlaced signals (signals obtained by interlace scanning every other line) if this is the case; and (4) a function for generating a control signal, which is for giving notification of an odd-numbered/even-numbered field, if the input video signal from the host apparatus 1 is an interlaced signal.

A communication circuit 3 for communicating with the host apparatus 1 receives the input video signal from the host apparatus 1 and sends and receives video signal information such as identification as to whether the signal is interlaced or non-interlaced, gamma correction data, brightness, contrast, screen position information and display mode (number of displayed dots and lines). A dither halftoning circuit 4 subjects the video data, which have been transferred from the input converting circuit 2, to dither processing with hysteresis. A dither-table rewrite control circuit 5 rewrites a multivalued dither table and a dither threshold-value table (dither threshold-value matrix) that are provided in the dither halftoning circuit 4. An XY address control circuit 6 decides threshold value data read in from the dither threshold-value table provided in the dither halftoning circuit 4. A frame memory control circuit 7 performs control for successively storing dithered halftone data, which have been output by the dither halftoning circuit 4, in a frame memory 8 and simultaneously outputting the dithered halftone data of the immediately preceding frame, as well as control for reading data out of the frame memory 8 in desired line units in response to an indication from a rewrite control circuit 10. A motion sensing circuit 9 senses motion by comparing the dithered halftone data of the immediately preceding frame with the current dithered halftone data. The rewrite control circuit 10 controls rewriting in line units based upon data from the motion sensing circuit 9 and rewrite speed information from a display unit 13. An interpolation/gradation control circuit 11 has a function which, in a case where the display dots and number of lines of the display unit 13 differ from the display dot data and line data in the input video signal after dither halftoning, is for producing data for display on the display unit 13 by interpolating the portion between them that is different, and a function which, in a case where the display dots and number of lines of the display unit 13 are greater, by a whole-number multiple, than the display dot data and line data in the input video signal after dither halftoning, is for increasing the number of tones by enlarging the input data and executing area gradation processing. A line output control circuit 12 transfers the input video signal after dither halftoning to the display unit 13 upon adding on a scanning address indicating at which position on the display unit 13 this input video signal is displayed. The display unit 13, which is constructed in the form of a matrix, is equipped with a display panel, a drive circuit and backlighting means, which are not shown. The display unit 13 has a read-only memory (ROM) (not shown) in which data indicating the number of colors capable of being displayed have been stored. These data are capable of being transferred by serial transfer from the display unit 13 to the dither-table rewrite control circuit 5. A user trimmer 15 allows the user to control image quality and screen position, etc. An image-quality/position adjusting circuit 14 converts the analog information from the user trimmer 15 to a digital signal and outputs the screen capture-position information that has been converted to the digital signal as well as gamma correction information, brightness and contrast information.

Ordinary dither halftoning will now be described. Dither halftoning is a technique in which, when input video data is composed of a digital signal of a plurality of dots for each pixel, noise having a predetermined period is applied in such a manner that the apparent halftone data will not be lost even if the digital signal is output to the display device upon being converted to a signal of a number of bits smaller than the number of bits originally possessed by the digital signal.

A case in which the input video data applied to the dither half toning circuit 4 is 8-bit data and a conversion to 2-bit data is performed when the video data is output will now be described with reference to FIGS. 2 and 3. In this case the input is an 8-bit digital signal and therefore is capable of taking on 256 values (0~255), whereas the output is a 2-bit digital signal and therefore is capable of taking on four values (0~3).

Figure 2:
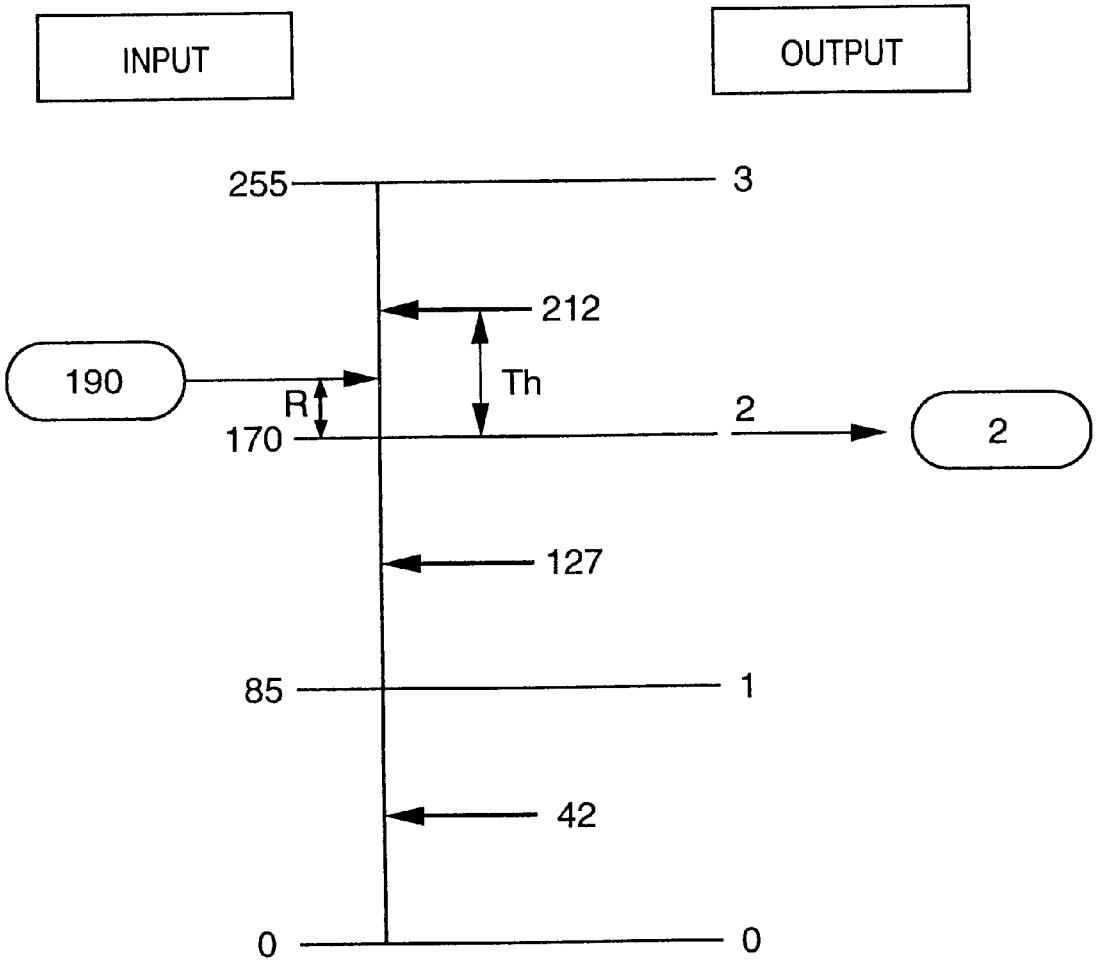
FIG. 2 is a diagram showing the relationship between input signals and output values in dither halftoning according to this embodiment.
Figure 3:
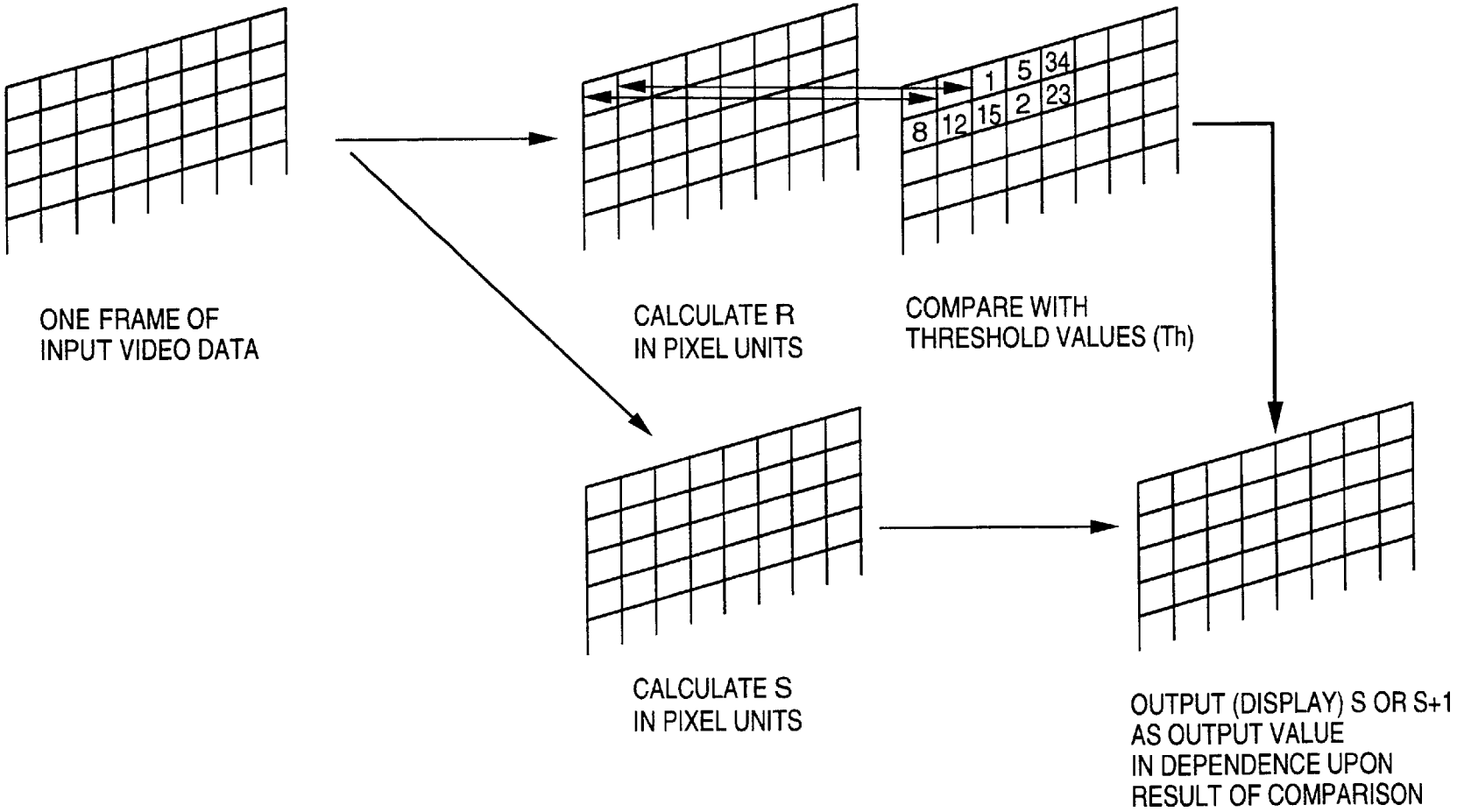
FIG. 3 is a diagram useful in describing dither halftoning according to this embodiment.

FIG. 2 is a diagram showing the relationship between input signals and output values in dither halftoning according to this embodiment, and FIG. 3 is a diagram useful in describing dither halftoning according to this embodiment.

First, a dither output value (referred to as an "output value" below) S in a case where the 8-bit input data has been converted to two bits is calculated. The formula for calculating the value S is represented by the following:

$$S=\text{quotient of (input value)}/[2\uparrow(\text{number of bits of input value})-1]/(2\uparrow(\text{number of bits of output value})-1] \quad \text{(Eq. 1)}$$

(where 2↑n represents 2 raised to the nth power).

Accordingly, in the example of FIG. 2, S is equal to the quotient of 190/(255/3), i.e. S=2, when the level of the input video signal is 190. In order to display the input value 190 by dither halftoning in such a manner that halftone data will not be lost, it is required that the output value S be changed to 2 or 3. With regard to whether the output value is made S or S+1, first the remainder R is calculated in accordance with the following equation:

$$R=\text{remainder of (input value)}/[2\uparrow(\text{number of bits of input value})-1]/(2\uparrow(\text{number of bits of output value})-1] \quad \text{(Eq. 2)}$$

Then the remainder R and a predetermined dither threshold value Th are compared and the output value is decided as follows:

$$\text{if } Th>R \text{ holds: output value } S \quad \text{(Eq. 3)}$$

$$\text{if } Th\leqq R \text{ holds: output value } (S+1) \quad \text{(Eq. 4)}$$

In the example of FIG. 2, R is 20 and Th is 42 (=212−170) and therefore the output value is 2 (=S).

By pseudo-reconstructing the halftone data by changing this threshold value Th at the above-mentioned predetermined period in dependence upon the position at which the input video data is displayed on the display unit 13, it is possible to realize a macroscopic multiple grayscale expression in a case where an output signal is produced using a number of bits less than that of the entered digital signal.

In a case where the number of bits of the output value is greater than the number of bits of the input, on the other hand, reconstruction of data to a form equivalent to that of the number of bits of the input value is possible depending upon how the types of dither threshold values are chosen. A relation giving the minimum required number k of types of dither threshold values is as follows:

$$2\uparrow(\text{number of bits of input value})=2\uparrow(\text{number of bits of output value})\times k \quad \text{(Eq. 5)}$$

Further, the range over which the dither threshold values are varied is decided as follows:

$$[2\uparrow(\text{number of bits of input value})-1]/[2\uparrow(\text{number of bits of output value})-1] \quad \text{(Eq. 6)}$$

where (number of bits of output value )>(number of bits of output value) holds.

Accordingly, if the number [=2↑(number of bits of output value)] of colors capable of being displayed on the display unit 13 is changed, then it is necessary to alter the variable range of the dither threshold values in accordance with the change in order to realize a macroscopic multiple grayscale expression. Further, it is necessary to make the alteration depending also upon the display mode (display dots, number of color and number of lines), which is changed by the graphics card placed in the computer.

In a case (which is the most prevalent) where the total number of pixels of the display unit is greater than the number of types of dither threshold values, the dither threshold values are used repeatedly. In other words, the input video signal is compared with the same dither threshold values at a predetermined period in accordance with the size of the matrix of the dither threshold values. This processing is repeated frame by frame.

Multivalued dither halftoning with hysteresis executed by the dither halftoning circuit 4 will be described next.

If an input signal near the dither threshold value enters and noise from the transmission system has been superposed upon this input signal, a worst-case scenario is image flicker caused by a frame-to-frame change in the dithered output value owing to the effects of the noise. In order to prevent this phenomenon, the output value in a frame which is at least the immediately preceding frame and the current output value are compared. If the amount of change is small, it is regarded as being noise and the dither threshold value or the value R is changed so as establish equivalence with the output value in the frame which is at least the immediately preceding frame. In other words, this method entails providing hysteresis in a case where there is a change in the output value after application of dither halftoning processing. In this case, the image display apparatus of FIG. 1 would have a hysteresis dither halftoning circuit, which is described below, added onto the dither halftoning circuit 4.

Figure 4:
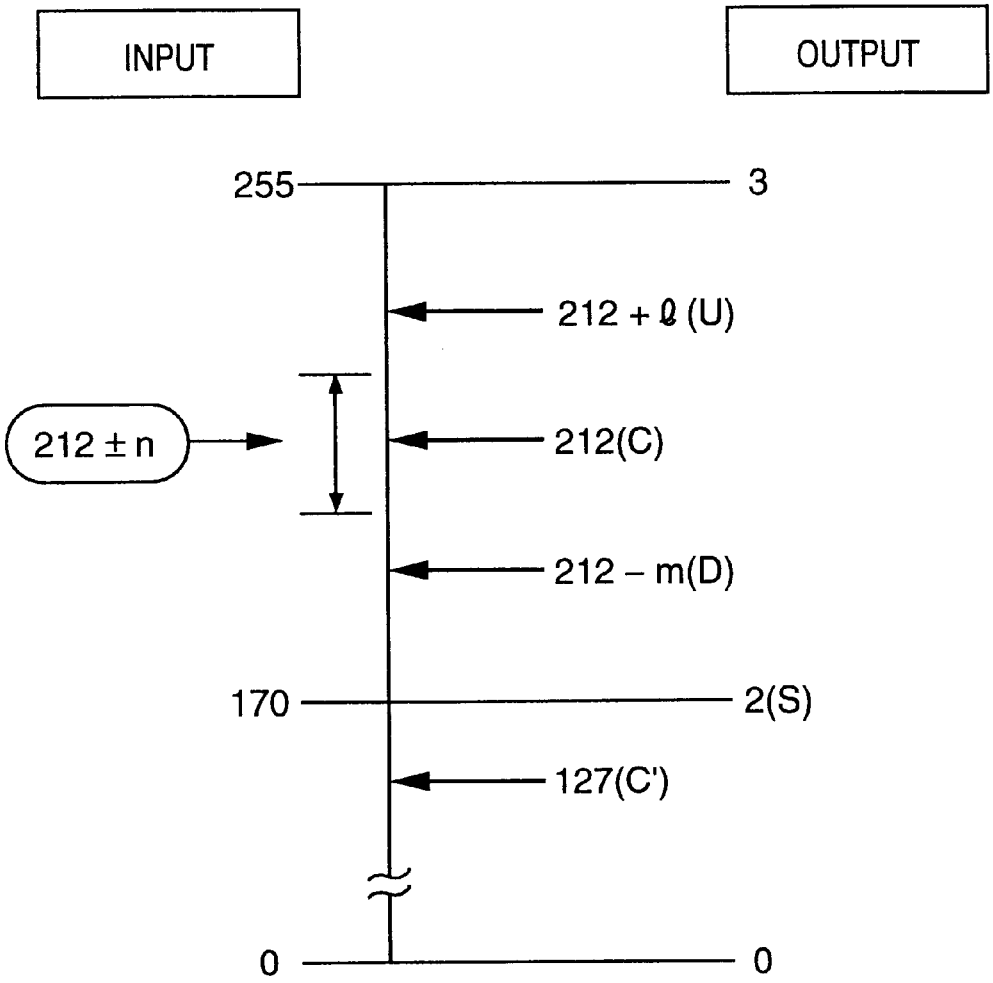
FIG. 4 is a diagram showing the relationship between input signals and output values in multivalued dither halftoning with hysteresis according to this embodiment.
Figure 5:
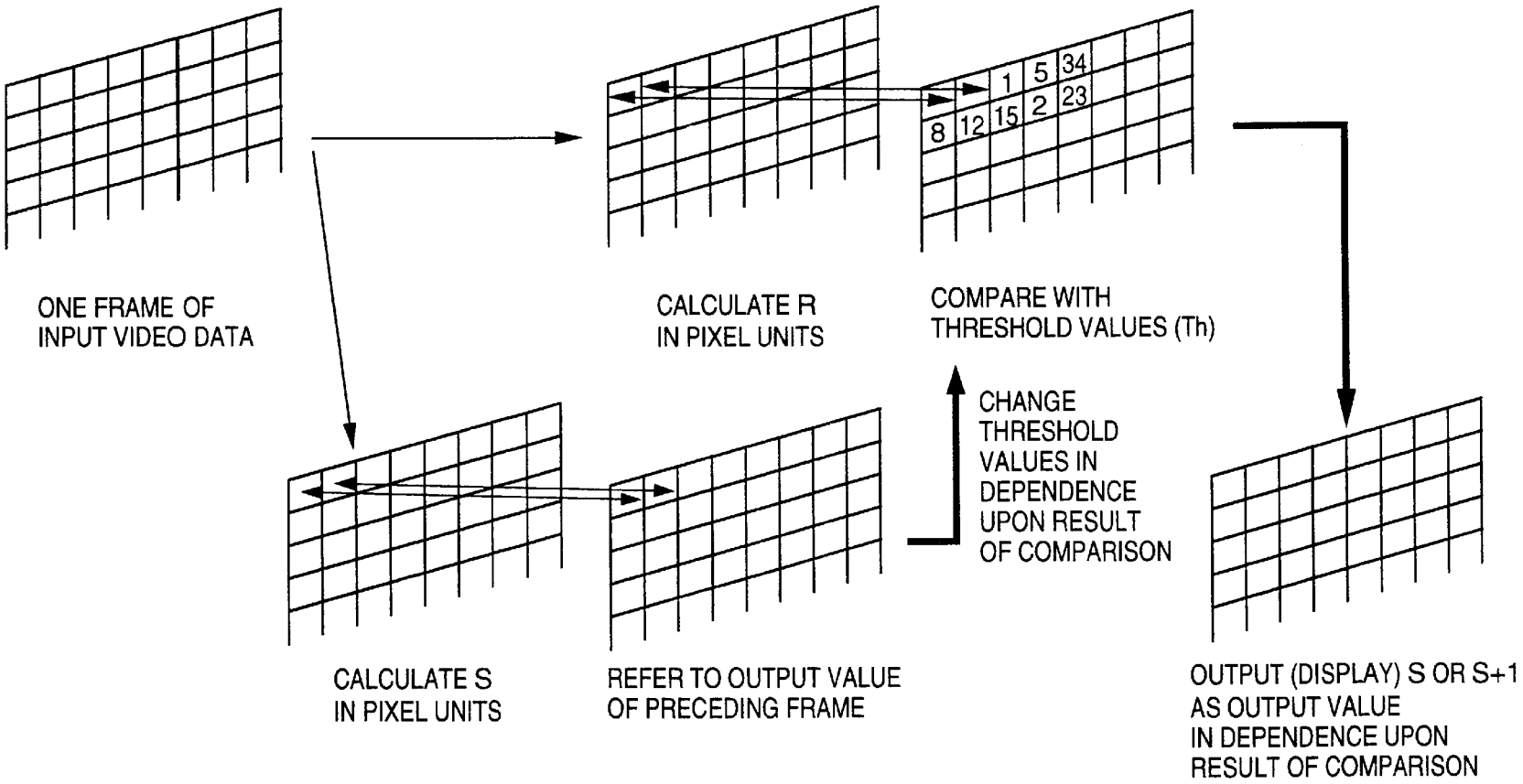
FIG. 5 is a diagram useful in describing multivalued dither halftoning with hysteresis according to this embodiment.

FIG. 4 is a diagram showing the relationship between input signals and output values in multivalued dither halftoning with hysteresis according to this embodiment, and FIG. 5 is a diagram useful in describing multivalued dither halftoning with hysteresis according to this embodiment.

The difference between this processing and the processing for multivalued dither halftoning described above is that the dither threshold value or the value of R is changed by dither output data corresponding to the same display position in a frame which is at least the immediately preceding frame. In this case also the input is an 8-bit digital signal and therefore is capable of taking on 256 values (0~255), whereas the output is a 2-bit digital signal and therefore is capable of taking on four values (0~3).

In this case the dither threshold value Th is decided as follows:

when the output value in the immediately preceding frame is S: dither threshold value Th=U when the output value in the immediately preceding frame is S+1: dither halftoning value Th=D when the output value in the immediately preceding frame is other than S~S+1: dither threshold value=C'

In the example of FIG. 4, the input value is 212±n (where n represents the amplitude of noise superposed by the transmission system, by way of example). If the output value in the immediately preceding frame was 2 (=S), then, rather than using the original dither threshold value 212 (=C), dither processing is executed using a threshold value of 212+1 (=U) so that the output value will tend to be 2. Conversely, if the output value in the immediately preceding frame was 3 (=S+1), then a threshold value of 212−m (=D) is used. On the other hand, if the output value in the immediately preceding frame was neither 2 (=S) nor 3 (=S+1), then the original threshold value 127 (=C'), which is smaller than 212, is used. The values of 1 and m may be the same or each may be changed individually.

Figure 6:
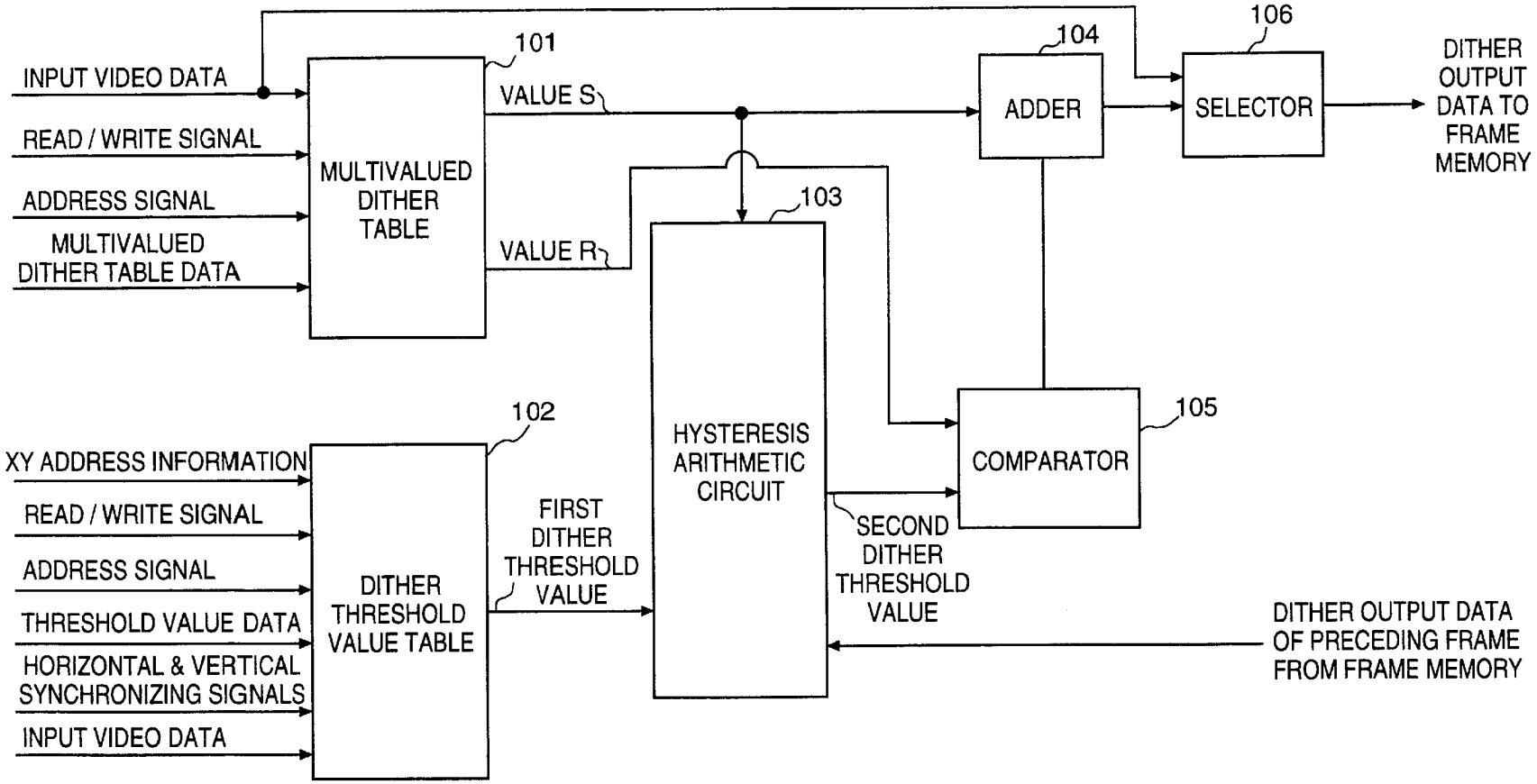
FIG. 6 is a block diagram illustrating a hysteresis dither halftoning circuit according to this embodiment.

The above-mentioned threshold values (U), (D) are obtained by the circuitry illustrated in FIG. 6.

FIG. 6 is a block diagram illustrating a hysteresis dither halftoning circuit according to this embodiment. This circuit is provided within the dither halftoning circuit 4.

As shown in FIG. 6, the input video data processed by the input converting circuit 2 enters a multivalued dither table 101, which outputs the values S and R calculated in accordance with Equations 1 and 2, respectively. When power is introduced to the dither halftoning circuit 4, each of these values in the multivalued dither table 101 is stored using an address signal and a read/write signal independence upon the number of bits of the input value (the input video data that has been processed by the input converting circuit 2) and the number of bits of the output value, which is the value S.

The horizontal and vertical synchronizing signals sent from the host apparatus 1 and XY address information, which is for judging at which position the video input data sent in accordance with the pixel clock signal in situated on the display screen, enter a dither threshold value table 102. A dither threshold value table suited to the video input signal is selected by the XY address information and is output to a hysteresis arithmetic circuit 103. The dither threshold value selected is changed by changing the XY address information.

A first dither threshold value output by the dither threshold value table 102 enters the hysteresis arithmetic circuit 103. Here the output value of a frame which is at least the immediately preceding frame stored in the frame memory 8 is compared with the value S, the dither threshold value is changed in the manner described above in conjunction with FIGS. 4 and 5 and this value is output to a comparator 105 as the second dither threshold value data. The comparator 105 compares the second dither threshold value data and the value R output by the multivalued dither table 101. If the second dither threshold value is smaller, 1 is added to the value S by an adder 104. The resulting value is delivered as an output value to the frame memory 8 via a selector 106. The selector 106 is for allowing the above-described hysteresis dithering processing to be bypassed and is actuated in a case where the video input data is output directly to the frame memory 8.

It should be noted that rather than changing the dither threshold value, as in this embodiment, the value of R may be changed by the dither data of the immediately preceding frame.

The overall operation of the image display apparatus shown in FIG. 1 will now be described.

First, when power is introduced to the apparatus, data representing the number of colors capable of being displayed by the display unit 13 is transferred to the dither-table rewrite control circuit 5 from a ROM (not shown) within the display unit 13. The dither-table rewrite control circuit 5 selects dither threshold values, which are necessary for displaying the number of colors represented by the input video signal that enters from the host apparatus 1, from the table in which these values have been stored in advance, or calculates the table, thereby rewriting the dither threshold values of the dither threshold value table 102 and the dither threshold values of the multivalued dither table 101 contained in the dither halftoning circuit 4. An arrangement may be adopted in which the number of bits of the input value from the input converting circuit 2 is predetermined or specified by the host using the communication circuit 3. Alternatively, the display mode may be calculated from the horizontal synchronizing signal within the input converting circuit 2, and the number of bits of this input value may be used. Rewriting of the dither tables is carried out not only when power is introduced but also when the display unit is modified or when the host apparatus 1 is modified and the display mode changed.

When the rewriting of the dither tables is finished, first the video signal output by the host apparatus 1 is converted by the input converting circuit 2 to video data suitable for each succeeding processing circuit. For example, if an entered video signal is an analog signal for a CRT, an A/D conversion is carried out. If the input video signal is a differential digital signal, the signal is converted to a TTL level or CMOS level. If the transfer frequency of the next stage is high, e.g. greater than 100 MHz, the video data path width is doubled by demultiplexing the video signal, thereby halving the transfer speed of the transfer clock (the pixel clock signal).

If the entered video signal is an interlaced signal as in the case of a television signal, the input converting circuit 2 outputs the relevant decision signal and a signal for discriminating between odd- and even-numbered fields.

The video signal converted by the input converting circuit 2 enters the dither halftoning circuit 4, which subjects the signal to the hysteresis dither halftoning described above.

The XY address control circuit 6 calculates the XY address information, which is necessary to select the dither threshold value table, based upon the horizontal and vertical synchronizing signals, the pixel clock signal, a signal indicative of whether demultiplexing has been performed or not, a signal indicative of whether interlacing has been performed or not, odd- and even-numbered field signals and image-capture position information.

The video signal thus subjected to dither halftoning processing is controlled by the frame memory control circuit 7 so that at least one frame thereof is stored in the frame memory 8. As long as input is not inhibited by control executed by the rewrite control circuit 10, the frame memory control circuit 7 updates the data in the frame memory 8 in frame units.

Meanwhile, the video data processed by the dither halftoning circuit 4 is sent to the motion sensing circuit 9 as well. At the same time that this video data enters the motion sensing circuit 9, dithered video data at the same display position in the frame that is at least the immediately preceding frame stored in the frame memory 8 enters the motion sensing circuit 9. The motion sensing circuit 9 compares the levels of these two items of entered data in pixel units. If the amount of the difference between them exceeds a certain threshold value th, this result is saved in horizontal line units, or in units of a certain area, as a portion of the image in which motion occurred. The saved data is transferred successively from the motion sensing circuit 9 to the rewrite control circuit 10. The latter outputs the portion in which motion is judged to have occurred to the interpolation/gradation control circuit 11. If motion has not been sensed, the entire screen is output from the frame memory 8 to the interpolation/gradation control circuit 11 by multiple interlacing in order that a refresh display may be presented to refresh the entire screen. This refresh operation is performed by multiple interlacing or random interlacing in order to prevent flicker. Non-interlacing may be employed in case of a display device that is free of flicker.

The dithered halftone data output by the frame memory 8 is sent to the interpolation/gradation control circuit 11, which interpolates or converts the data to the display dots and lines suited to the display unit 13. The data is transferred to the display unit 13 after scanning address information is added on by the line output control circuit 12. This scanning address information is data indicative of a line designated in the rewrite control circuit 10 with regard to the frame memory 8. On the basis of the transferred video data and scanning address data, the display unit 13 paints the video data on the line designated by the scanning address via a drive circuit (not shown) within the display unit 13.

The operation of the XY address control circuit 6 will now be described.

The XY address control circuit 6 is so adapted as to be capable of changing, in appropriate fashion, the XY address information for selecting the dither threshold value data. The following three scenarios may be assumed:

(1) a scenario in which the position at which the data that enters the dither halftoning circuit 4 is captured is shifted in the X direction and/or Y direction;

(2) a scenario in which the data that enters the dither halftoning circuit 4 is demultiplexed and transferred in parallel pixel by pixel; and (3) a scenario in which the data that enters the dither halftoning circuit 4 is an interlaced signal.

Each of these scenarios will now be discussed.

(1) In the scenario in which the position at which the data that enters the dither halftoning circuit 4 is captured is shifted in synchronization with the period of the horizontal synchronizing signal, the pixel clock is counted using the horizontal synchronizing signal as the trigger, a display enable signal is asserted when the count attains a desired value and the display enable signal is negated after the number of pixels to be captured have been captured. During the time that the display enable signal is at the "H" level, the video signal is captured by the dither halftoning circuit 4 and the captured data is successively compared with the dither threshold values starting from the leading pixel.

Figure 7:
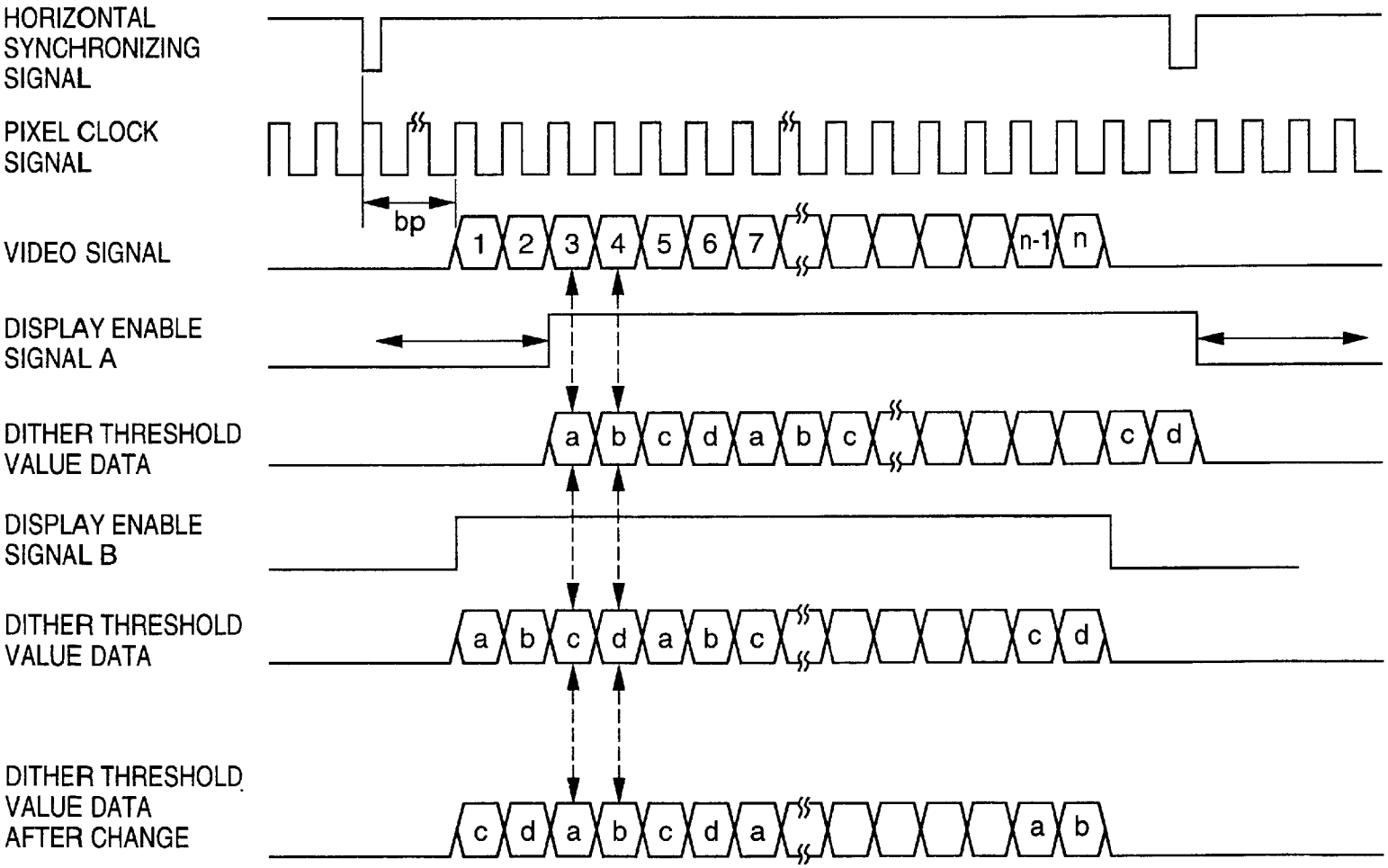
FIG. 7 is a timing chart illustrating an instance in which data capture by an XY address control circuit has been shifted according to this embodiment.

FIG. 7 is a timing chart illustrating an instance in which data capture by the XY address control circuit has been shifted according to this embodiment;

In the example of FIG. 7, the third pixel of the video signal is compared with a dither threshold value a if a display enable signal A is at the "H" level. Similarly, the fourth pixel is compared with a dither threshold value b and the fifth pixel is compared with a dither threshold value c if the display enable signal A is at the "H" level.

An example in which the position at which the video signal is captured is changed will be illustrated below. If the video signal and the dither threshold values are compared in dependence upon the period of time during which a display enable signal B is at the "H" level in a case where the display enable signal is changed in the manner of the display enable signal B in order to change the position at which the video signal is captured, the third pixel will be compared with the threshold value c. Accordingly, the dither threshold value compared before the capture position is changed is different from that after the capture position is changed. Accordingly, the XY address information which selects the dither threshold value is shifted and set in such a manner that the dither threshold value after the change in capture position will be the same as that before the change in capture position. This example is illustrated by the dither threshold value data at the bottom of FIG. 7.

(2) The scenario in which the input video signal has been demultiplexed will now be described with reference to FIG. 8.

Figure 8:
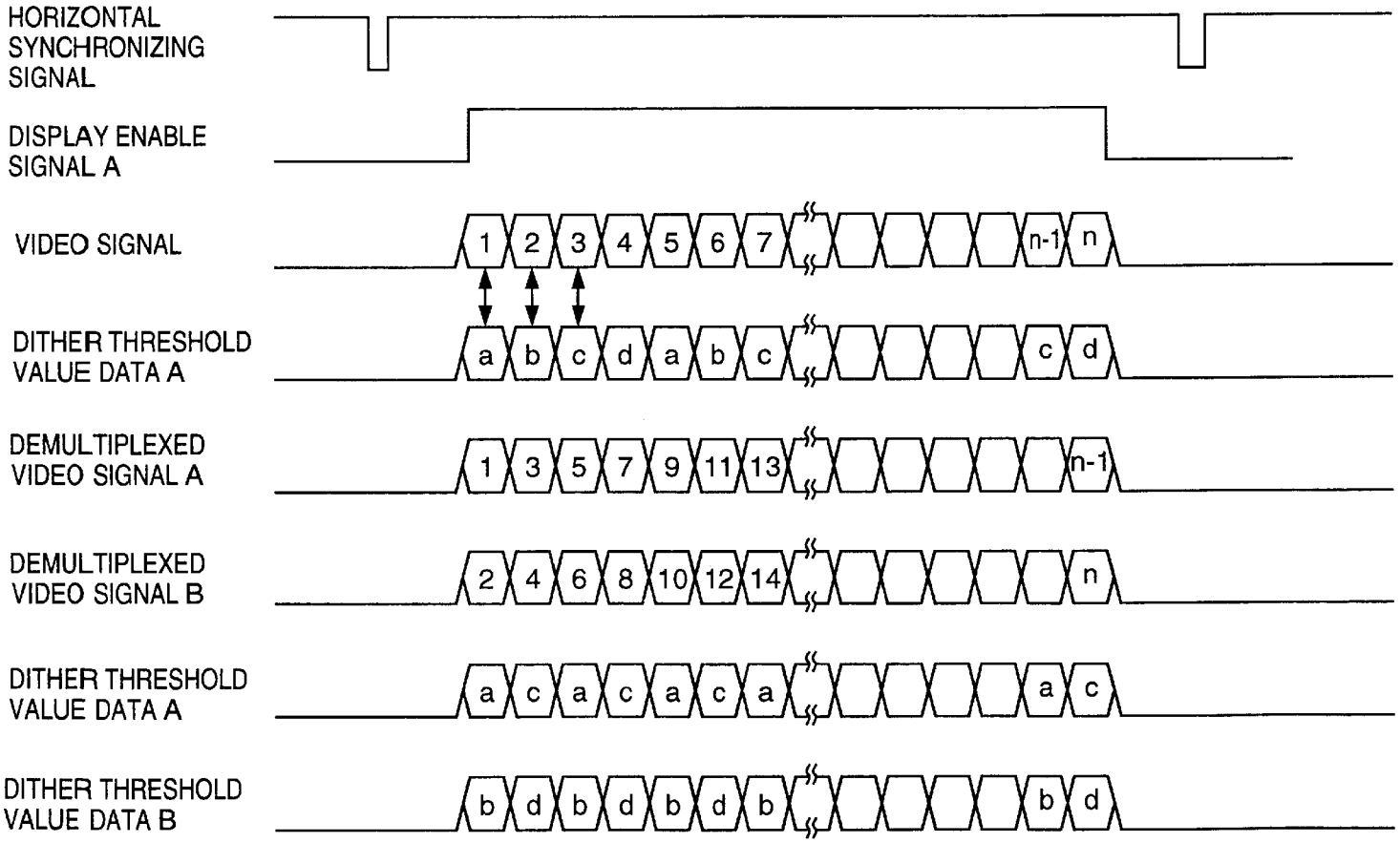
FIG. 8 is a timing chart illustrating an instance in which an input video signal has been demultiplexed according to this embodiment.

FIG. 8 is a timing chart illustrating an instance in which the input video signal has been demultiplexed according to this embodiment.

If the video signal has not been demultiplexed, the first pixel is compared with the threshold value a, as illustrated by the dither threshold value data A. Similarly, the second pixel is compared with the dither threshold value b and the third pixel is compared with the dither threshold value c. On the other hand, if this video signal has been demultiplexed and transmitted in parallel fashion for the purpose of lowering the transmission speed, as described earlier, then, in the example of FIG. 8, the video signal is transferred at the timings of demultiplexed signals A and B. The dither threshold value data A and B may be obtained by shifting the selecting XY address information.

(3) In the scenario in which an interlaced video signal has entered the dither halftoning circuit 4, the data of the even-numbered lines or the data of the odd-numbered lines continue in alternating fashion. Unless the dither threshold value data in the vertical direction is changed to a value different from that which prevails in the case of non-interlacing, the dither threshold value data to which the comparison is made will differ from that which prevails in the case of non-interlacing. Accordingly, if an interlaced signal is sensed, the XY address information in the vertical direction is changed and adjusted in such a manner that the dither threshold value will be the same as that in case of the non-interlaced signal.

Figure 9:
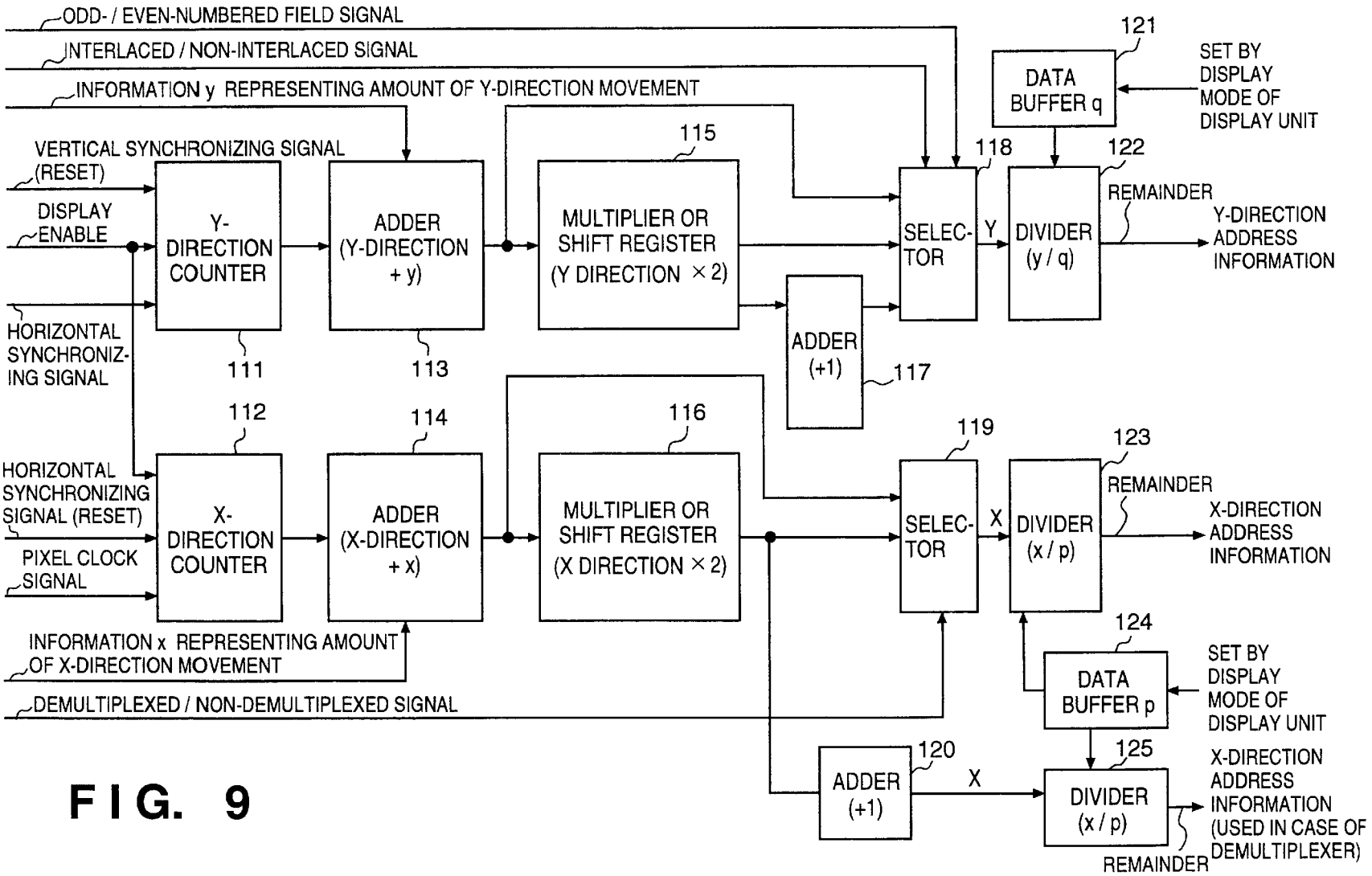
FIG. 9 is a block diagram illustrating an XY address control circuit in a case where an input video signal is an interlaced signal according to this embodiment.
Figure 10:
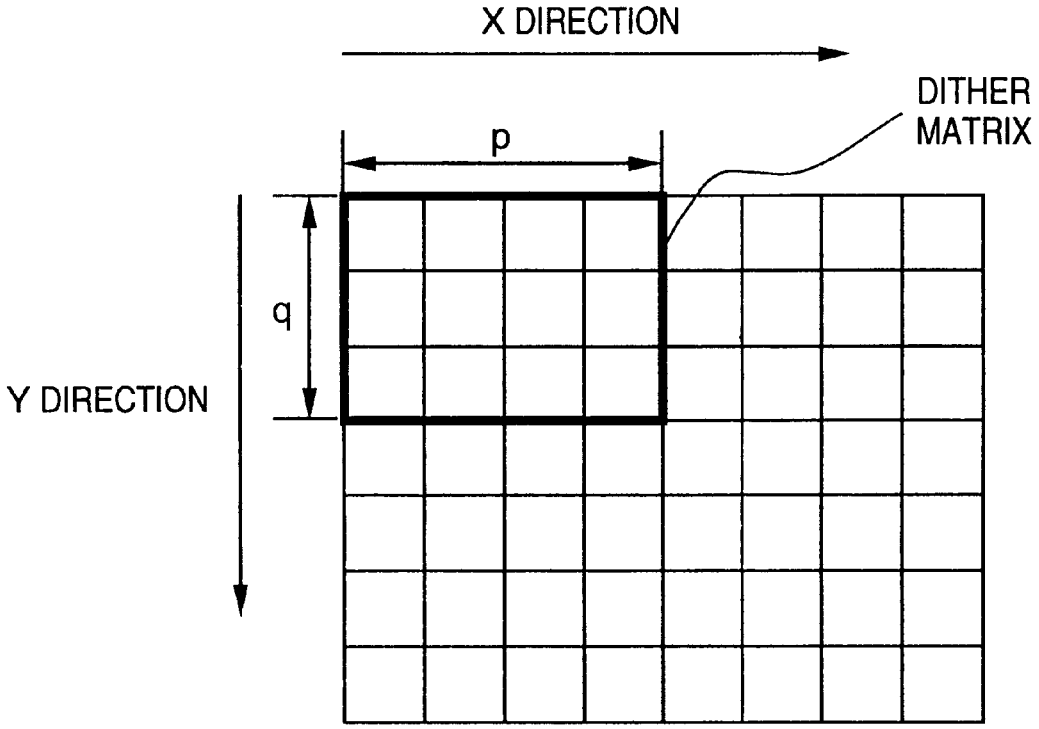
FIG. 10 is a diagram useful in describing the XY address control circuit in a case where the input video signal is an interlaced signal according to this embodiment.

FIG. 9 is a block diagram illustrating the XY address control circuit 6 in the case where the input video signal is an interlaced signal according to this embodiment, and FIG. 10 is a diagram useful in describing the XY address control circuit 6 in the case where the input video signal is an interlaced signal according to this embodiment.

In the example of FIG. 10, the size of the dither matrix is p in the X direction and q in the Y direction.

Generation of Address Information in Y Direction

The generation of address information in the Y direction will be described first. Basically, the address in the Y direction is generated by counting the horizontal synchronizing signal by a Y-direction counter 111, which has been reset by the vertical synchronizing signal, during the period of display enable. If the capture position is changed in the Y direction, the address in the Y direction is changed by adding on the amount of the change (information indicating amount of movement in the Y direction) by means of an adder 113 to which the output of the counter 111 is connected. The capture position, which is the Y-direction address obtained, enters a selector 118 via three the following three paths: The first path is for a case where an interlaced signal and an even-numbered field signal have been sensed by the selector 118. In such case the Y-direction address is doubled by a multiplier (or shift register) 115. The second path is for a case where an interlaced signal and an odd-numbered field signal have been sensed by the selector 118. In such case the Y-direction address is doubled by a multiplier (or shift register) 115 and then 1 is added to the doubled signal by an adder 117. The third path is for a case where a non-interlaced signal has been sensed, in which case the capture position data obtained by the adder 113 enters the selector 118. The selection of the path is performed based upon whether an interlaced or non-interlaced signal has entered the selector 118 and, in the case of the interlaced signal, whether the odd- or even-numbered field signal has entered the selector 118. If the output value of the selector 118 exceeds the value q, then, in order to use the same dither threshold value again, the output value is divided by q in a divider 122, and the value of the remainder is adopted as the amount of change (the Y-direction address information). The value q is information indicative of the number of colors (information indicative of the input/output bits) of the display unit 13. The size of the dither matrix in the Y direction is set in a data buffer 121 based upon the display mode of the display unit 13.

Generation of Address Information in X Direction

The generation of address information in the X direction will be described next. Basically, the address in the X direction is generated by counting the pixel clock signal by an X-direction counter 112, which has been reset by the horizontal synchronizing signal, during the period of display enable. If the capture position is changed in the X direction, the address in the X direction is changed by adding on the amount of the change (information indicating amount of movement in the X direction) by means of an adder 114 to which the output of the counter 112 is connected. The capture position, which is the X-direction address obtained, enters a selector 119 via the following two paths: The first path is for a case where demultiplexed signal has been sensed by the selector 119. In such case the X-direction address is doubled by a multiplier (or shift register) 116. The second path is for a case where the signal is not a demultiplexed signal. In such case the capture position obtained by the adder 114 enters the selector 119. The selection of the path is performed depending upon whether or not a demultiplexed signal enters the selector 119. If the output value of the selector 119 exceeds the value p, then, in order to use the same dither threshold value again, the output value is divided by p in a divider 123, and the value of the remainder is adopted as the amount of change (the X-direction address information). An adder 120 adds 1 to the X-direction address doubled by the multiplier (or shift register) 116. If this value exceeds the value p, then, in order to use the same dither threshold value again, this value is divided by p in a divider 125 and the value of the remainder is adopted as the amount of change (the X-direction address information). The value p is information indicative of the number of colors (information indicative of the input/output bits) of the display unit 13. The size of the dither matrix in the X direction is set in a data buffer 124 based upon the display mode of the display unit 13. The X-direction address information obtained by the divider 125 is used in a situation where demultiplexing processing is executed. If demultiplexing is to be performed, it is required that two consecutive dither threshold values in the dither matrix be obtained at the same timing (a and b, as well as c and d, in FIG. 8, by way of example). Accordingly, two items of X-direction address information for obtain the dither threshold values are required simultaneously, and hence the dividers 123, 125 are necessary. These two items of X-direction address information are obtained by adding 1 to one item of the information in adder 120 in such a manner that the dither threshold values are rendered consecutive in the X direction.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the present invention can also be achieved by providing a storage medium storing program codes for performing the aforesaid functions of the foregoing embodiment to a system or an apparatus, reading the program codes with a computer (e.g., a CPU or MPU) of the system or apparatus from the storage medium, and then executing the program.

In this case, the program codes read from the storage medium implement the functions according to the embodiments, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, the present invention covers a case where an operating system (OS) or the like working on the computer performs a part of or the entire process in accordance with the designation of program codes and implements the functions according to the embodiments.

Furthermore, it goes without saying that the present invention further covers a case where, after the program codes read from the storage medium are written to a function extension board inserted into the computer or to a memory provided in a function extension unit connected to the computer, a CPU or the like contained in the function extension board or function extension unit performs a part of or the entire process in accordance with the designation of program codes and implements the function of the above embodiments.

Thus, in accordance with the present invention, as described above, there are provided an image display apparatus and an image display method through which optimum dither halftoning processing is performed in a case where the position at which an input video signal is displayed is changed and in a case where the input video signal is an interlaced signal and/or a demultiplexed signal. Furthermore, the optimum number of dithered halftones can be expressed even in a case where display panels having different displayable colors are connected to the apparatus and even when input video signals having different display modes are accepted.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus for dither halftoning a video signal that enters from an external unit and displaying the resulting video signal on a display unit, comprising:

a dither halftoning circuit converting the video signal to a dither output signal by using dither threshold values; and an XY address control circuit generating X-direction and Y-direction address signals for specifying dither threshold values used in said dither halftoning circuit, said control circuit including:

a Y-direction counter generating the Y-direction address signal by counting a horizontal synchronizing signal which is reset by a vertical synchronizing signal;

a multiplier doubling the generated Y-direction address signal;

an adder adding 1 to the doubled Y-direction address signal; and a selector selecting, when the inputted video signal is an interlaced signal, the Y-direction address signal outputted from said multiplier or said adder on the basis of whether an odd- or even-numbered field signal is received by said selector.

2. The apparatus according to claim 1, wherein said XY address control circuit further includes a second adder adding value indicating an amount of movement in the Y-direction, which represents a changed capture position of the video signal, to the Y-direction address signal generated by said Y-direction counter and outputting the added Y-direction address signal to said multiplier.

3. The apparatus according to claim 1, wherein said XY address control circuit further includes a divider dividing an output address signal outputted from said selector by a size of a dither matrix in the Y direction and outputting a value of the remainder thereof to said dither halftoning circuit.

4. An image display apparatus for dither halftoning a video signal that enters from an external unit and displaying the resulting video signal on a display unit, comprising:

a dither halftoning circuit converting the video signal to a dither output signal by using dither threshold values; and an XY address control circuit generating X-direction and Y-direction address signals for specifying dither threshold values used in said dither halftoning circuit, with said XY address control circuit including:

an X-direction counter generating the X-direction address signal by counting a pixel clock signal which is reset by a horizontal synchronizing signal;

a multiplier doubling the generated X-direction address signal; and an adder adding 1 to the doubled X-direction address signal, wherein said XY address control circuit selects, when the inputted video signal is a demultiplexed signal, both the X-direction address signal of said multiplier and said adder.

5. The apparatus according to claim 4, wherein said XY address control circuit further includes a second adder adding value indicating an amount of movement in the X-direction, which represents a changed capture position of the video signal, to the X-direction address signal generated by said X-direction counter and outputting the added X-direction address signal to said multiplier.

6. The apparatus according to claim 4, with said XY address control circuit further including:

a first divider dividing the output address signal outputted from said multiplier by a size of a dither matrix in the X direction and outputting the value of the remainder thereof to said dither halftoning circuit; and a second divider dividing the output address signal outputted from said adder by a size of the dither matrix in the X direction and outputting the value of the remainder thereof to said dither halftoning circuit.

* * * * *

UNITED STATES PATENT AND TRADEMARK OFFICE

CERTIFICATE OF CORRECTION

PATENT NO. : 6,084,560

DATED : July 4, 2000

INVENTOR(S): KATSUHIRO MIYAMOTO

It is certified that error appears in the above-identified patent and that said Letters Patent is hereby corrected as shown below:

COLUMN 11:

Line 39, "three" (first occurrence) should be deleted.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*